US009010298B2

(12) United States Patent
Namba

(10) Patent No.: US 9,010,298 B2
(45) Date of Patent: Apr. 21, 2015

(54) ROLLOVER DETECTION DEVICE FOR GENERAL-PURPOSE ENGINE

(75) Inventor: Masaharu Namba, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 131 days.

(21) Appl. No.: 13/083,646

(22) Filed: Apr. 11, 2011

(65) Prior Publication Data

US 2011/0253093 A1 Oct. 20, 2011

(30) Foreign Application Priority Data

Apr. 16, 2010 (JP) ..... 2010-094583

(51) Int. Cl.

| | |
|---|---|
| ***F01M 11/10*** | (2006.01) |
| ***F02D 17/00*** | (2006.01) |
| ***F02B 77/08*** | (2006.01) |
| ***F02M 63/02*** | (2006.01) |
| ***F01M 11/06*** | (2006.01) |
| *F02B 63/02* | (2006.01) |

(52) U.S. Cl.

CPC ..... *F01M 11/064* (2013.01); *F02B 63/02* (2013.01); *F02B 77/08* (2013.01)

(58) Field of Classification Search

CPC ..... F02D 17/04; F01L 1/00; F01L 1/02; F01M 5/025; F01M 11/12; F01M 2005/028; F01M 1/24; F04B 43/009; F04B 33/005; F04B 2205/05; F04B 35/04; F04B 17/03; F04B 39/0094; F02B 3/06; F02P 11/025; F02P 11/02

USPC ..... 123/196 S; 417/63, 415

See application file for complete search history.

(56) References Cited

U.S. PATENT DOCUMENTS

| | | | | |
|---|---|---|---|---|
| 5,014,820 | A * | 5/1991 | Evans | 184/6.3 |
| 5,076,250 | A | 12/1991 | Sasaki et al. | |
| 5,531,290 | A * | 7/1996 | Furuichi et al. | 180/271 |
| 5,669,349 | A * | 9/1997 | Iwata et al. | 123/335 |
| 5,846,102 | A * | 12/1998 | Nitta et al. | 440/1 |
| 6,626,138 | B2 * | 9/2003 | Sayama et al. | 123/149 R |
| 6,742,994 | B2 * | 6/2004 | Hironaka et al. | 417/63 |
| 6,772,725 | B2 * | 8/2004 | Inaba et al. | 123/192.2 |

FOREIGN PATENT DOCUMENTS

| | | |
|---|---|---|
| JP | 4-241713 | 8/1992 |
| JP | 9-49414 | 2/1997 |
| JP | 2713765 | 10/1997 |
| JP | 3122696 | 5/2006 |

* cited by examiner

*Primary Examiner* — Lindsay Low
*Assistant Examiner* — Syed O Hasan
(74) *Attorney, Agent, or Firm* — Smith, Gambrell & Russell, LLP

(57) ABSTRACT

A general-purpose engine equipped with a rollover detection device for a general-purpose engine that is used for driving a driving unit such as a rammer. An oil pan is provided in a crankcase of an engine main body, and lubricating oil is supplied to a lubrication part of the engine main body by an oil pump. A suction port of a lubricating oil intake part that guides the lubricating oil to an intake port of the oil pump is provided in a substantially central part in front-rear and left-right directions of the oil pan. Therefore, even when the general-purpose engine rolls over in the front-rear or left-right direction, the lubricating oil does not enter the lubricating oil intake part. Detecting whether or not the lubricating oil is discharged from the oil pump allows detection of a rollover of the general-purpose engine.

19 Claims, 7 Drawing Sheets

17: General-purpose engine
20: Crankcase
51: Oil pan
52: Oil pump
59: Lubricating oil suction pipe
62: Suction port (A)

(B)

ROLLOVER DETECTION DEVICE FOR GENERAL-PURPOSE ENGINE

CROSS-REFERENCE TO RELATED APPLICATIONS

The present application claims priority from Japanese Patent Application No. 2010-094583 filed on Apr. 16, 2010, the entire contents of which are hereby incorporated by reference.

BACKGROUND OF THE INVENTION

1. Field of the Invention

The present invention relates to a rollover detection device for a general-purpose engine for detecting a rollover of a driving unit such as a rammer that is driven by a general-purpose engine.

2. Description of the Related Art

A rolling compaction machine for use in compacting a paved surface or ground surface is called a "rammer." As described in Japanese Utility Model Registration No. 3122696, a general-purpose engine is used for driving a rolling compaction plate, or a rammer member, wherein the rammer member serves as a member to be driven by the general-purpose engine. The general-purpose engine mounted in a driving unit such as a rammer has a crankcase in which a crankshaft is installed rotatably, and a cylinder in which a piston connected to the crankshaft by a piston rod is incorporated so as to be able to reciprocate axially. A bottom part of the crankcase is provided with an oil pan to store lubricating oil. The lubricating oil is supplied to a lubrication section, which is a sliding section such as a bearing that supports the crankshaft rotatably. The crankcase is provided with an oil pump for supplying the lubricating oil to the sliding section, and the oil pump is driven by the crankshaft.

As described in Japanese Unexamined Patent Application Publication Nos. 1992-241713 and 1997-49414, a strainer is incorporated in a tip end of a lubricating oil feed pipe for guiding the lubricating oil to the oil pump. The lubricating oil within the oil pan is drawn through the strainer, functioning as a drawing port, into the lubricating oil feed pipe and then supplied to the sliding section.

Japanese Patent No. 2713765, on the other hand, describes an engine stop device that is provided with a detection switch for detecting the amount of lubricating oil stored in an oil pan of a general-purpose engine, and stops the engine when the amount of lubricating oil drops to a certain level or lower.

The driving unit such as a rammer is tilted when used, depending on the conditions in which the driving unit is used. When the driving unit is tilted, naturally the general-purpose engine mounted in such a driving unit is also tilted. Even when the driving unit is tilted under normal use, the lubricating oil within the oil pan can be supplied to the oil pump and hence to the sliding section. However, if the driving unit rolls over, even when the engine is driven while having a predetermined amount of lubricating oil stored in the oil pan, the lubricating oil cannot be suctioned into the lubricating oil feed pipe.

With regard to rollover directions in which the driving unit such as a rammer can roll over, there are two, front and rear, rollover directions where the front surface side or the rear surface side of the engine is tilted downward, and there are two, left and right, rollover directions where the left-side surface or the right-side surface of the engine is tilted downward. The driving unit sometimes rolls over in multiple directions, such as to the front and to the right. When the driving unit rolls over in such a manner, the lubricating oil cannot be guided to the oil pump or supplied to the sliding section. Subsequently, the lubricating oil enters the inside of the piston or other parts that require no lubrication. In this case, the engine needs to be stopped. Examples of the conditions where the driving unit rolls over include not only when the front surface side or the rear surface side of the engine is tilted completely downward, but also when the driving unit tilts to the extent that the engine needs to be stopped.

Although detection of a rollover of the engine was attempted by attaching a rollover sensor to the driving unit, it is inevitable for the rollover sensor to erroneously detect a rollover of the driving unit such as a rammer, which vibrates. Thus, a rollover could not be detected accurately.

Because the lubricating oil within the oil pan is not guided to the lubricating oil feed pipe when the driving unit rolls over, a pressure sensor is provided at a discharge port of the oil pump to detect that the lubricating oil is not discharged from the oil pump and thereby detect a rollover of the driving unit.

However, it is necessary to take into consideration that the driving unit rolls over in all of front-rear and left-right directions described above. In a general-purpose engine in which the oil pump is incorporated in an end wall part of the crankcase and the strainer is incorporated within the end wall part, the pressure sensor cannot detect a rollover in a certain direction. In other words, when the driving unit rolls over in such a direction where an opening part of the strainer is tilted upward, the lubricating oil is stopped from being guided from the opening part of the strainer to the lubricating oil feed pipe, and consequently the pressure of the lubricating oil in the discharge port of the oil pump can be detected to determine the rollover of the driving unit. On the other hand, when the driving unit rolls over in such a direction where the opening of the strainer is tilted downward, the lubricating oil is guided from the opening part to the lubricating oil feed pipe, and, as a result, the rollover of the driving unit cannot be detected.

SUMMARY OF THE INVENTION

An object of the present invention is to be able to detect a rollover of a driving unit in any direction when the driving unit is driven by a general-purpose engine.

A rollover detection device for a general-purpose engine according to the present invention is a rollover detection device for a general-purpose engine for detecting a rollover of a driving unit that has a member to be driven by an engine, the rollover detection device including: an engine main body that has a cylinder in which a piston is installed so as to be able to reciprocate, and a crankcase in which a crankshaft connected to the piston by a connecting rod is installed rotatably; an oil pan provided in a bottom part of the crankcase and storing lubricating oil; an oil pump that is driven to rotate by the crankshaft; a lubricating oil intake part, a suction port of which is provided at a position away from an end wall surface and side wall surface of the oil pan, and which guides the lubricating oil to an intake port of the oil pump; a lubricating oil discharge part that guides the lubricating oil to a nozzle that supplies the lubricating oil, which is discharged from a discharge port of the oil pump, to a lubrication section within the engine main body; discharge detecting means for detecting whether or not the lubricating oil is discharged from the discharge port of the oil pump; and engine stop control means for stopping the engine when the lubricating oil is not discharged into the lubricating oil discharge part.

The rollover detection device for a general-purpose engine according to the present invention is characterized in that the engine stop control means stops the engine when a state in which the lubricating oil is not discharged into the lubricating oil discharge part continues for a stop determination time or longer. The rollover detection device for a general-purpose engine according to the present invention is characterized in that the suction port of the lubricating oil intake part is opened at a central part of the oil pan in both a direction along the crankshaft and a direction perpendicular to the crankshaft. The rollover detection device for a general-purpose engine according to the present invention is characterized in that the oil pump is installed in an end wall part of the crankcase in which the crankshaft is supported rotatably, that an intake-side communication hole is formed within the end wall part, that a lubricating oil suction pipe formed with the suction port is attached to an opening part of the intake-side communication hole that is opened to the oil pan, and that the lubricating oil intake part is formed by the intake-side communication hole and the lubricating oil suction pipe. The rollover detection device for a general-purpose engine according to the present invention is characterized in that a discharge-side communication hole for allowing a communication between the discharge port and the nozzle is formed in the end wall part, and that the lubricating oil discharge part is formed by the discharge-side communication hole.

The rollover detection device for a general-purpose engine according to the present invention is characterized in that the discharge detecting means is a pressure sensor that detects a pressure of the lubricating oil discharged to the lubricating oil discharge part, and outputs a detection signal to the engine stop control means when a discharge pressure reaches a lubrication pressure. The rollover detection device for a general-purpose engine according to the present invention is characterized in that the discharge detecting means is disposed within the lubricating oil discharge part. The rollover detection device for a general-purpose engine according to the present invention is characterized in that within the lubricating oil intake part there is provided a filtering member for filtering the lubricating oil that is supplied from within the oil pan to the nozzle. The rollover detection device for a general-purpose engine according to the present invention is characterized in that the filtering member is attached to a sealing plug that is detachably installed in the lubricating oil intake part, and that the lubricating oil stored in the oil pan is discharged through the lubricating oil intake part by removing the sealing plug from the crankcase along with the filtering member.

According to the present invention, because the lubricating oil within the oil pan is stopped from being discharged toward the discharge port of the oil pump when the general-purpose engine rolls over, detecting whether or not the lubricating oil is discharged to the discharge port allows detection of the rollover of the general-purpose engine. A rollover of the general-purpose engine in any direction, whether a front-rear direction in which the crankshaft tilts or a left-right direction in which the crankshaft rotates, can be reliably detected.

Determining whether or not the general-purpose engine rolls over is performed after the stop determination time elapses since the lubricating oil is stopped from being discharged to the discharge port. In this manner, the rollover is determined after the engine is started and consequently the oil pump driven by the engine enters a steady state thereof. As a result, a rollover determination can be prevented from being erroneously performed when the engine is started while the rollover detection device is in a normal upright state.

DESCRIPTION OF THE PREFERRED EMBODIMENTS

Figure 1:
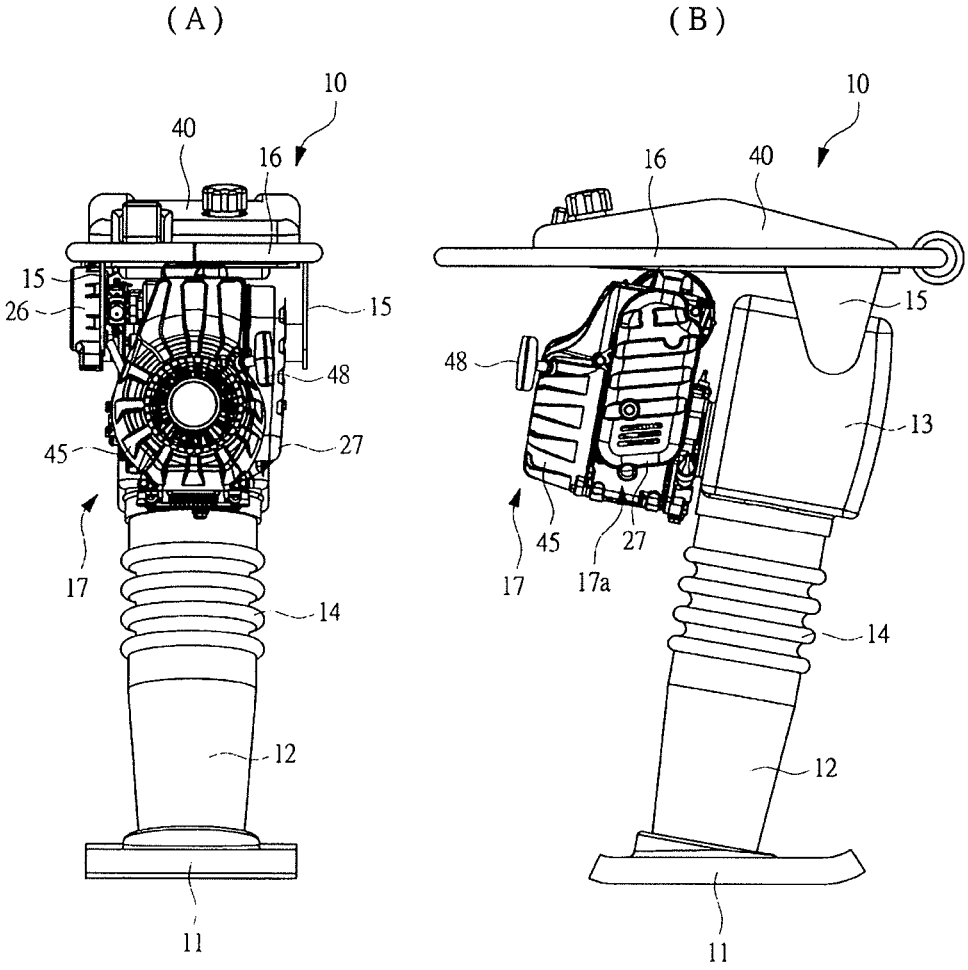
FIG. 1A is a rear view showing an operation surface of a rammer serving as a driving unit provided with a rollover detection device for a general-purpose engine according to an embodiment of the present invention.
FIG. 1B is a side view of the rear view shown in FIG. 1A.

Embodiments of the present invention are now described hereinafter in detail with reference to the drawings. A rammer 10, a tamping rammer functioning as a rolling compaction machine driven by a general-purpose engine, has a rammer member 11 as a member to be driven by the general-purpose engine, as shown in FIG. 1. The rammer member 11, also known as a "rolling compaction plate" or "rolling compaction member," is provided in a lower end part of a cylindrical leg part 12. The leg part 12 is installed to be able to freely move vertically with respect to a rammer crankcase 13, and a flexible boot 14 made of rubber or the like is provided between the rammer crankcase 13 and the leg part 12. Within the rammer crankcase 13 there is provided an eccentric crankshaft that is driven to rotate by an output axis of a centrifugal clutch, which is not shown. The eccentric crankshaft is connected to the leg part 12 via a piston rod.

As shown in FIG. 1, support frames 15 are attached on the left and right sides of the rammer crankcase 13. A substantially rectangular operating handle 16 is attached to these support frames 15. The operating handle 16 extends to the rear of the rammer crankcase 13 above the rammer crankcase 13. Therefore, when compacting a ground surface, an operator grasps a rear end of the operating handle 16 to move the rammer 10. As shown in FIG. 1B, when the rammer 10 stands upright on the ground surface, the leg part 12 and the rammer crankcase 13 are tilted forward. When the rammer 10 is tilted in this manner, the position of the center of gravity is concentrated on the front side of the rammer member 11, improving the straight traveling performance upon moving the rammer 10.

Figure 2:
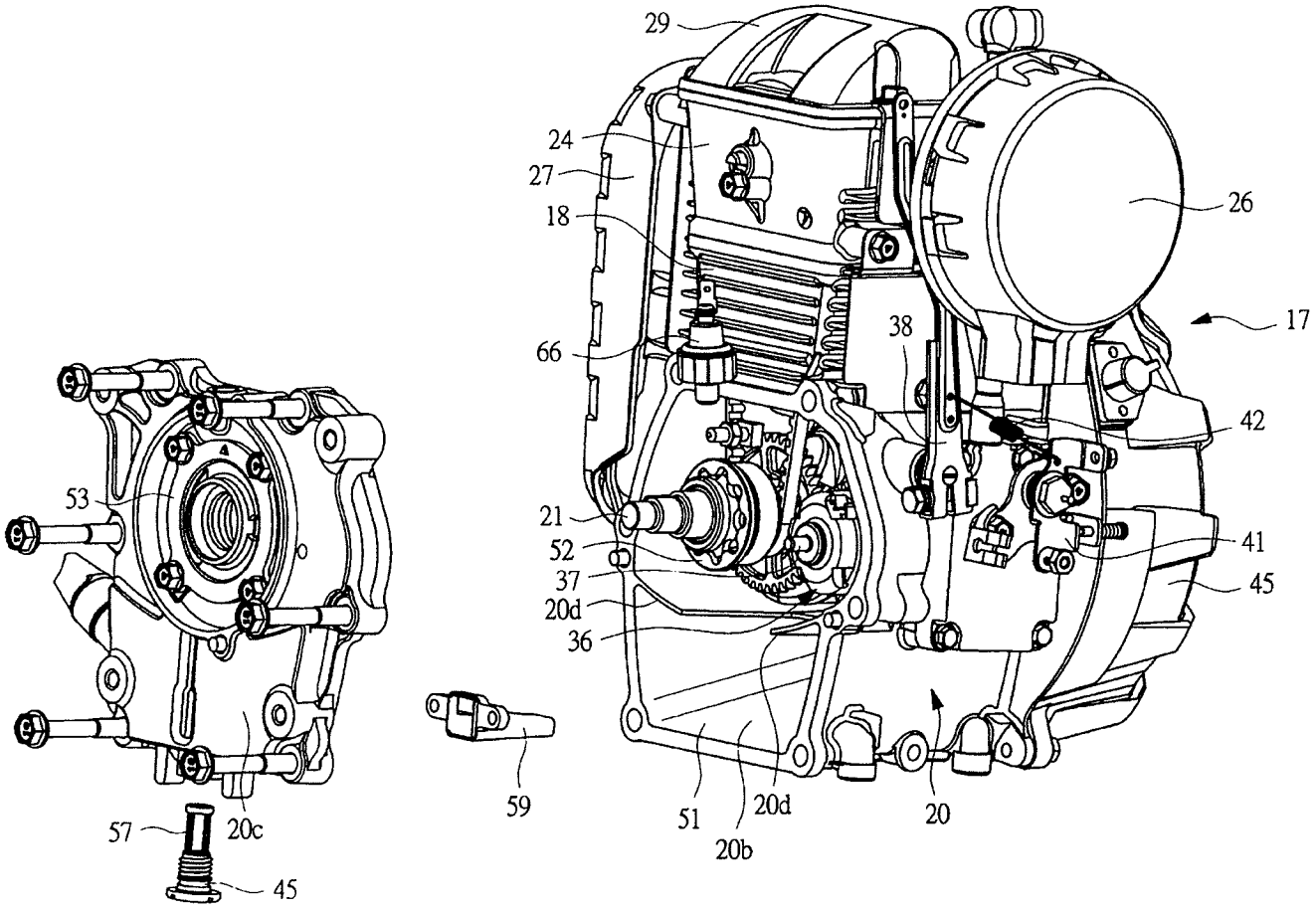
FIG. 2 is an exploded perspective view showing an engine main body of the general-purpose engine mounted in the rammer of FIG. 1.
Figure 3:
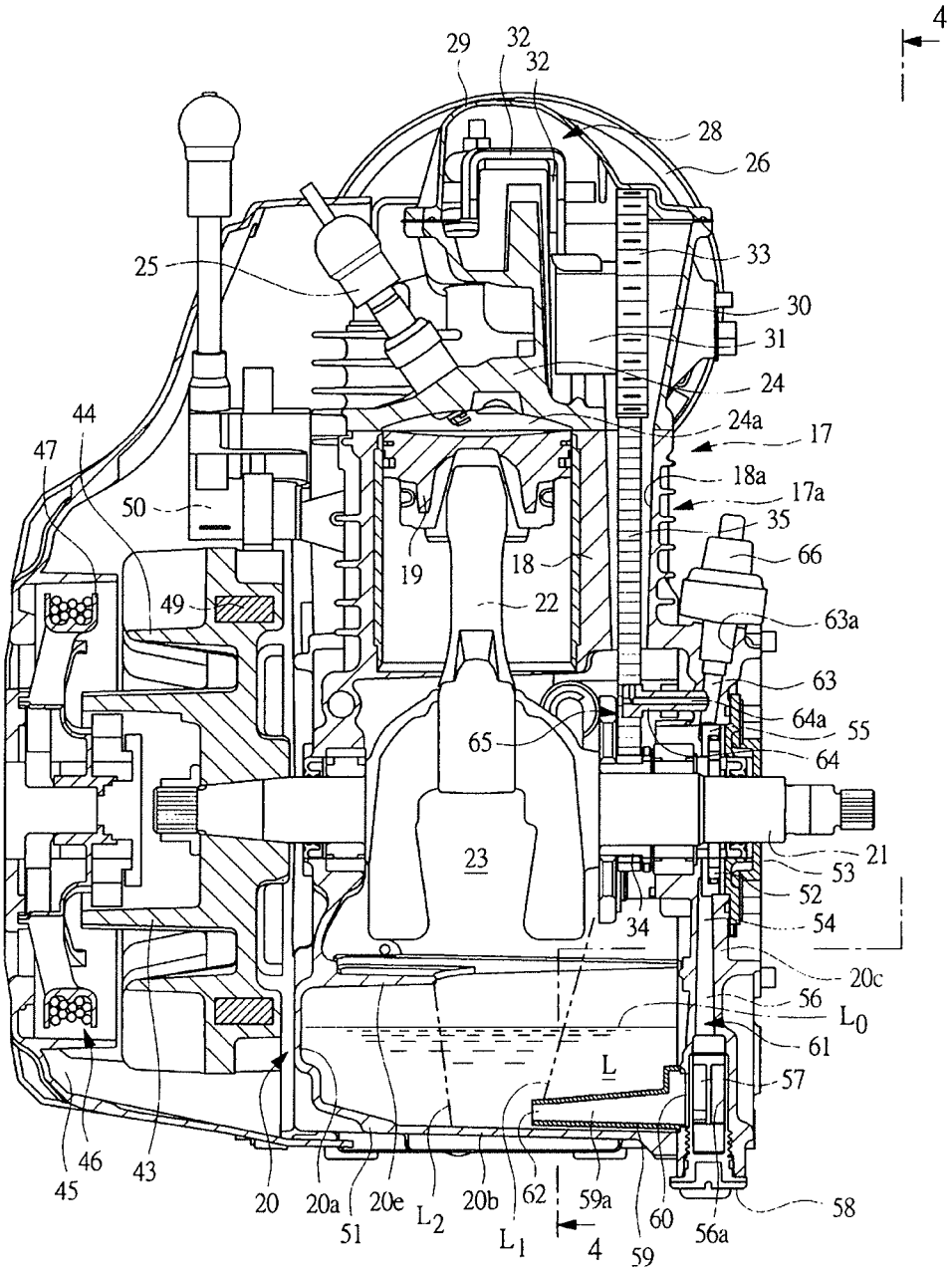
FIG. 3 is a vertical cross-sectional view of the engine main body.
Figure 4:
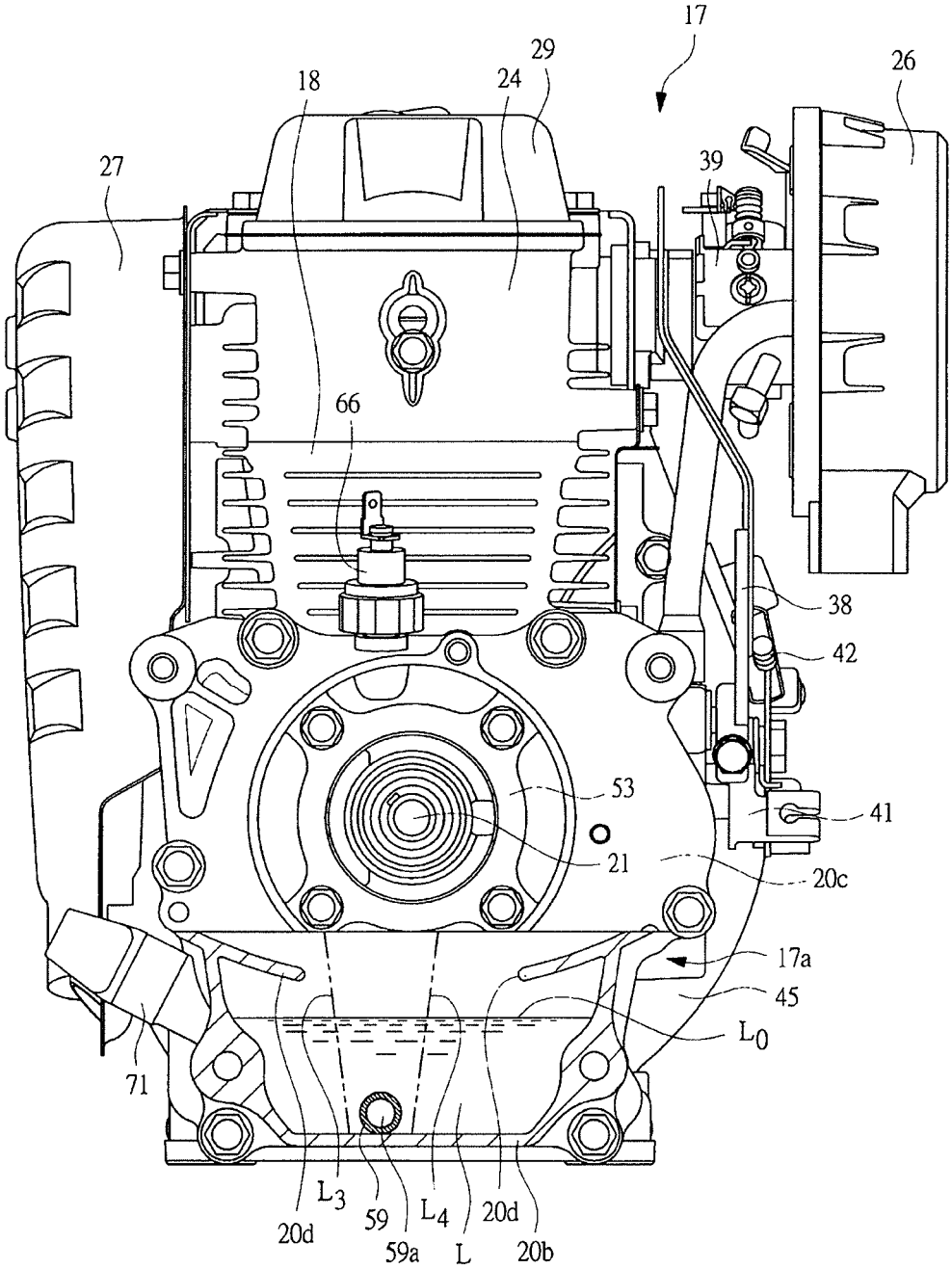
FIG. 4 is a partial cutaway front view of the engine main body taken along line 4-4 of FIG. 3.

A general-purpose engine 17 is installed on the rear surface side of the rammer crankcase 13, which is the operation surface of the rammer crankcase 13. This general-purpose engine 17 is a four-cycle single-cylinder engine with a cylinder 18, as shown in FIGS. 2 to 4. A piston 19 is incorporated in the cylinder 18 so as to be able to reciprocate linearly. The piston 19 is connected to a crankshaft 21 by a connecting rod 22. The crankshaft 21, installed rotatably in a crankcase 20, is driven to rotate as the piston 19 reciprocates. The crankcase 20 and the cylinder 18 constitute an engine main body 17*a*. The crankshaft 21 projects from the front surface side of the engine main body 17*a* into the rammer crankcase 13 and is connected to the eccentric crankshaft of the rammer crankcase 13 by the centrifugal clutch, which is not shown. As shown in FIG. 4, the side having the crankshaft 21 which projects toward the rammer crankcase 13 in the general-purpose engine 17 is taken as the front surface of the general-purpose engine 17 and the other side as the rear surface.

As shown in FIGS. 2 and 3, the crankcase 20 has a main body part 20*b* in which a storage 23 is formed integrally with an end wall part 20*a*, and an end wall part 20*c* attached to an opening end part of the main body part 20*b*, wherein the storage 23 within the crankcase 20 is hermetically closed by attaching the end wall part 20*c* to the main body part 20*b*.

A cylinder head 24, fixed to the cylinder 18, has formed therein an inlet port, not shown, for supplying an air-fuel mixture to a combustion chamber 24*a*, and an outlet port, not shown, for discharging combustion gas. As shown in FIG. 3, an ignition plug 25 for igniting the mixture projects into the combustion chamber 24*a* and is attached to the cylinder head 24. An air cleaner 26 for cleaning the outside air supplied to the inlet port is attached to one of the side surfaces of the engine main body 17*a*, as shown in FIG. 2, and a muffler 27 for muffling the sound of exhaust discharged from the outlet port is attached to the other side surface of the engine main body 17*a*. As shown in FIGS. 2 and 4, the air cleaner 26 is attached to the right-side surface and the muffler 27 to the left-side surface, as viewed from the front surface of the engine main body 17*a*.

The cylinder head 24 is provided with an inlet valve, not shown, for opening/closing the inlet port and an outlet valve, also not shown, for opening/closing the outlet port. The inlet valve and the outlet valve are each driven to open/close by a dynamic valve mechanism 28. The dynamic valve mechanism 28 is covered by a locker cover 29 attached to the cylinder 18 and has a camshaft 30 that is installed in the cylinder head 24 in parallel with the crankshaft 21. One end part of a locker arm 32 for the inlet valve and one end part of a locker arm 32 for the outlet valve that are installed swingably in the cylinder head 24 abut on a dynamic valve cam 31 provided in the camshaft 30. The other end of the locker arm 32 for the inlet valve is connected to the inlet valve, and the locker arm 32 for the outlet valve is connected to the outlet valve. A timing belt 35 is stretched between a sprocket 33 attached to the cylinder head 24 and a sprocket 34 attached to the crankshaft 21. The camshaft 30 is driven to rotate by the crankshaft 21. The timing belt 35 extends between the sprockets 33 and 34 through a through-hole 18*a* formed in the cylinder 18.

As shown in FIG. 2, a mechanical governor 36 for steadily adjusting the rotation speed of the engine without being affected by load variations is attached within the crankcase 20. The mechanical governor 36 has a rotary shaft 37 that is driven to rotate by the crankshaft 21. A governor sleeve, not shown, is installed in the rotary shaft 37 so as to be able to move axially. A governor lever 38 is attached to a governor shaft swung by the governor sleeve, and a tip end part of the governor lever 38 is connected to a throttle valve that is incorporated within a carburetor 39 shown in FIG. 4. A speed control lever 41 is installed swingably on a side surface of the engine main body 17*a*. The speed control lever 41 is connected to the governor lever 38 by a coil spring 42. As shown in FIG. 1, the operating handle 16 is provided with a fuel tank 40, and the fuel within the fuel tank 40 is supplied to the carburetor 39.

As shown in FIG. 3, the crankshaft 21 projects from a rear surface of the crankcase 20, and a rotor 43 is attached to this projecting end part. The rotor 43 is provided with a cooling fan 44 for generating cooling air toward the engine main body 17*a*. The cooling fan 44 is covered by a fan cover 45 that is attached to the rear surface of the engine main body 17*a*, and an inner surface of the fan cover 45 is provided with a recoil starter 46 for starting the engine. The recoil starter 46 has a recoil pulley 47 that is installed rotatably to the inner surface of the fan cover 45. A tip end of a recoil rope wrapped around the recoil pulley 47 is provided with an operating knob 48. As shown in FIG. 1, the operating knob 48 is disposed outside the fan cover 45. Pulling out the operating knob 48 to rotate the recoil pulley 47 allows an engagement click of the recoil pulley 47 to be engaged with the rotor 43 by a centrifugal force. As a result, the crankshaft 21 rotates and the engine is started.

As shown in FIG. 3, a magnet 49 is incorporated within the rotor 43, and a magneto coil 50 is installed in a side surface of the engine main body 17*a*. Therefore, once the engine is started and the rotor 43 is driven to rotate, the magneto coil 50 generates electric power. The generated electric power is supplied to the electrical equipment such as the ignition plug 25.

A bottom part of the crankcase 20 is provided with an oil pan 51 for storing lubricating oil L. As shown in FIGS. 2 and 4, partitioning projections 20*d* project inward from either side of the main body part 20*b* of the crankcase 20, wherein tip end parts of the partitioning projections 20*d* are tilted downward. Furthermore, as shown in FIG. 3, a partitioning projection 20*e* projects from the end wall part 20*a* toward the end wall part 20*c* on the other side. Therefore, the lubricating oil L is prevented from scattering upward from the oil pan 51 during normal use of the rammer.

An oil pump 52 is installed in the end wall part 20*c* of the crankcase 20 in order to supply the lubricating oil L to the connection part between the crankshaft 21 and the connecting rod 22, as well as lubrication sections or sliding sections such as a bearing for supporting the crankshaft 21 in the crankcase 20. The oil pump 52 is disposed between the end wall part 20*c* and a cover 53 attached thereto. The oil pump 52 is driven by the crankshaft 21 to discharge the lubricating oil L, supplied to an intake port 54 of the oil pump 52, from a discharge port 55.

An intake-side communication hole 56 is formed in the end wall part 20*c* in order to guide the lubricating oil L of the oil pan 51 to the intake port 54. A lower end part of this intake-side communication hole 56, which is a radial outer portion located with respect to the crankshaft 21, configures a large diameter part 56*a* larger than an upper end part of the intake-side communication hole 56. This large diameter part 56*a*, opened to the outside of the end wall part 20*c*, opens downward when the rammer 10 is set upright. A filter 57 serving as a filtering member is detachably installed in the large diameter part 56*a* that is opened to the outside. This filter 57 is attached to a sealing plug 58 that is screwed to the end wall part 20*c*. When the sealing plug 58 is removed from the end wall part 20*c*, the filter 57 is also removed along with the sealing plug 58, whereby the lubricating oil L within the oil pan 51 can be discharged to the outside. In this manner, by attaching the filter 57 to the sealing plug 58 which is detachably installed in the intake-side communication hole 56, the filter 57 can be attached or removed using the sealing plug 58.

Additionally, by removing the sealing plug 58, the intake-side communication hole 56 can be used as a channel for discharging the lubricating oil.

As shown in FIG. 3, a lubricating oil suction pipe 59 in which an oil passage 59*a* is formed is attached to an inner surface of the end wall part 20*c*. A base end part of the oil passage 59*a* of the lubricating oil suction pipe 59 is communicated with an opening part 60 that is formed in the end wall part 20*c* in relation to the filter 57. In this manner, the lubricating oil suction pipe 59 is opened to the oil pan 51 and attached to the opening part 60 formed in the end wall part 20*c*. The lubricating oil suction pipe 59 is disposed in a bottom part of the oil pan 51. Together with the intake-side communication hole 56, the lubricating oil suction pipe 59 forms a lubricating oil intake part 61 for guiding the lubricating oil L to the intake port 54. Forming the intake-side communication hole 56 in the end wall part 20*c* by using the end wall part 20*c* to configure a part of the lubricating oil intake part 61 eliminates the need to attach a pipe member for forming the lubricating oil intake part 61 in the end wall part 20*c*, so that the lubricating oil intake part 61 can be formed in a limited space.

As shown in FIG. 3, a suction port 62 that is provided in a tip end part of the lubricating oil suction pipe 59 is opened at a central part in the bottom part of the oil pan 51 in a direction along the crankshaft 21, in other words, a front-rear direction of the engine main body 17*a*. The suction port 62 is opened in a position away from the inner surfaces of the end wall parts 20*a* and 20*c*, which are the front and rear end wall surfaces of the oil pan 51. As shown in FIG. 4, the suction port 62 is opened to the oil pan 51 at a central part in the left-right direction of the engine main body 17*a*, which is a central part in the direction perpendicular to the crankshaft 21. The suction port 62 is further opened in a position away from inner surfaces of left and right side wall parts of the main body part 20*b*, which are left/right-side wall surfaces of the oil pan 51.

A discharge-side communication hole 63 that is communicated with the discharge port 55 of the oil pump 52 is formed in the end wall part 20*c*, and a nozzle 64 in which an oil passage 64*a* communicated with the discharge-side communication hole 63 is formed is attached to the end wall part 20*c*. The discharge-side communication hole 63 forms a lubricating oil discharge part 65 for guiding the lubricating oil L, discharged from the discharge port 55, to the nozzle 64. Forming the discharge-side communication hole 63 in the end wall part 20*c* using the end wall part 20*c* to configure a part of the lubricating oil discharge part 65 eliminates the need to attach a pipe member for forming the lubricating oil discharge part 65 in the end wall part 20*c*, so that the lubricating oil discharge part 65 can be formed in a limited space.

The lubricating oil L that is pressurized to lubrication pressure by the oil pump 52 is injected from a tip end part of the nozzle 64 to the sliding sections, or the lubrication sections. As shown in FIG. 3, an injection port from which the lubricating oil L is injected to the left and an injection port from which the lubricating oil L is injected upward are formed on the tip end part of the nozzle 64. The lubricating oil L is supplied to the connection part between the crankshaft 21 and the connecting rod 22, as well as the sliding sections such as the bearing for supporting the crankshaft 21 in the crankcase 20. The lubricating oil L is further injected to an inner surface of the timing belt 35. The lubricating oil L that is sprayed to the timing belt 35 adheres thereto as the timing belt 35 rotates, and is then supplied into the locker cover 29 as well, through the through-hole 18*a*. The lubricating oil L guided into the locker cover 29 is supplied to sliding sections of the dynamic valve mechanism 28.

An upper end part of the discharge-side communication hole 63, which is a radial outer portion located with respect to the crankshaft 21, configures a large diameter part 63*a* larger than a lower end part of the discharge-side communication hole 63. The large diameter part 63*a* is opened to the outside of the end wall part 20*c*. A pressure sensor 66 that serves as the discharge detecting means for detecting whether or not the lubricating oil is discharged from the discharge port 55 of the oil pump 52 is attached to the large diameter part 63*a* opened to the outside. This pressure sensor 66 outputs a detection signal when the pressure of the lubricating oil L discharged from the discharge port 55 of the oil pump 52 reaches the lubrication pressure, but does not output any signals when the pressure does not reach the lubrication pressure. Various types of pressure sensors, such as a semiconductor pressure sensor or piezoelectric pressure sensor, can be used as the pressure sensor 66. Whether the rammer 10 is rolled over or not is detected based on the signal output from the pressure sensor 66.

In FIGS. 3 and 4, a reference numeral L0 represents an oil level of the lubricating oil L in the front-rear direction, which is obtained when the crankshaft 21 lies horizontally and the engine main body 17*a* is placed vertically without being tilted in the left-right direction. In this state, the suction port 62 of the lubricating oil suction pipe 59 is located below the oil level L0 and submerged in the lubricating oil L. The injection amount of the lubricating oil L is set such that the oil level is lower than the heights of the partitioning projections 20*d* and 20*e* configuring the oil pan 51. As shown in FIG. 1B, since the rammer 10 is tilted, for example, approximately 10 degrees forward when the rammer 10 is set upright, the oil level L0 is tilted with respect to the crankshaft 21 when the rammer 10 is set upright.

When the oil level comes to the level shown by a reference numeral L1 in FIG. 3 by tilting the engine main body 17*a* by a predetermined degree or more in a direction in which the rammer 10 is largely tilted forward and consequently the front surface of the engine main body 17*a* is tilted downward, the suction port 62 protrudes above the oil level L1 because the suction port 62 is provided in the position away from the end wall part 20*c* forming the wall on the front surface side of the oil pan 51. On the other hand, when the oil level comes to the level shown by a reference numeral L2 by tilting the engine main body 17*a* by a predetermined degree or more in the direction in which the rear surface of the engine main body 17*a* is tilted downward, the suction port 62 becomes located above the oil level L2 because the suction port 62 is provided in the position away from the end wall part 20*a* forming the wall on the rear surface side of the oil pan 51. When the rammer 10 is tilted to the extent that the general-purpose engine 17 almost rolls over in the manner described above, the lubricating oil L is stopped from being supplied to the sliding sections that need to be lubricated, even when the engine is driven and consequently the oil pump 52 is driven.

In FIG. 4, a reference numeral L0 represents the oil level of the lubricating oil L in the left-right direction, which is obtained when the crankshaft 21 lies horizontally and the engine main body 17*a* is placed vertically without being tilted in the left-right direction. The suction port 62 of the lubricating oil suction pipe 59 is located below the oil level L0 and submerged in the lubricating oil L.

As shown in FIG. 4, when the oil level comes to the level shown by a reference numeral L3 by tilting the engine main body 17*a* by a predetermined degree or more in a direction in which the rammer 10 is largely tilted to the left as viewed from the front and consequently the left-side surface of the engine main body 17*a* is tilted downward, the suction port 62 protrudes above the oil level L3 because the suction port 62 is provided in the position away from the inner surface of the left-side wall part of the main body part 20*b* that forms the left-side wall of the oil pan 51. On the other hand, when the oil level comes to the level shown by a reference numeral L4 by tilting the engine main body 17*a* by a predetermined degree or more in a direction in which the right-side surface of the engine main body 17*a* is tilted downward, the suction port 62 becomes above the oil level L4 because the suction port 62 is provided in the position away from the inner surface of the right-side wall part of the main body part 20*b* that forms the right-side wall of the oil pan 51. When the rammer 10 is tilted to the extent that the general-purpose engine 17 almost rolls over in the manner described above, the lubricating oil L is stopped from being supplied to the sliding sections that need to be lubricated, even when the engine is driven and consequently the oil pump 52 is driven.

FIG. 5A is a cross-sectional view showing a liquid level of the lubricating oil L within the oil pan, which is obtained when the rammer rolls over to the extent that the front surface side of the engine main body is tilted completely downward. FIG. 5B is a cross-sectional view showing a liquid level within the oil pan, which is obtained when the rammer rolls over to the extent that the front surface side of the engine main body is tilted completely upward. In each of these conditions where the rammer 10 rolls over, the crankshaft 21 is placed substantially vertically. When the engine main body 17*a* rolls over to the extent that the condition shown in FIG. 5A is obtained, the suction port 62 projects above an oil level L5. When, on the other hand, the engine main body 17*a* rolls over to the extent that the condition shown in FIG. 5B is obtained, an oil level L6 becomes located below the suction port 62.

FIG. 6A is a cross-sectional view showing a liquid level of the lubricating oil L within the oil pan 51, which is obtained when the rammer rolls over to the extent that the left-side surface of the engine main body 17*a* is tilted completely downward. FIG. 6B a cross-sectional view showing a liquid level within the oil pan 51, which is obtained when the rammer rolls over to the extent that the left-side surface of the engine main body 17*a* is tilted completely upward. When the engine main body 17*a* rolls over to the left to the extent that the condition shown in FIG. 6A is obtained, the suction port 62 becomes located above an oil level L7. When the engine main body 17*a* rolls over to the right to the extent that the condition shown in FIG. 6B is obtained, the suction port 62 becomes located above an oil level L8. In either direction in which the engine main body 17*a* rolls over, the suction port 62 separates from the oil level. Therefore, the lubricating oil L is stopped from being discharged from the discharge port 55 even when the oil pump 52 is driven.

When the lubricating oil L is no longer discharged from the discharge port 55, the pressure sensor 66 stops outputting the pressure detection signals. As a result, the rollover of the general-purpose engine 17, or the rollover of the rammer 10, can be determined based on the pressure detection signals.

Figure 5:
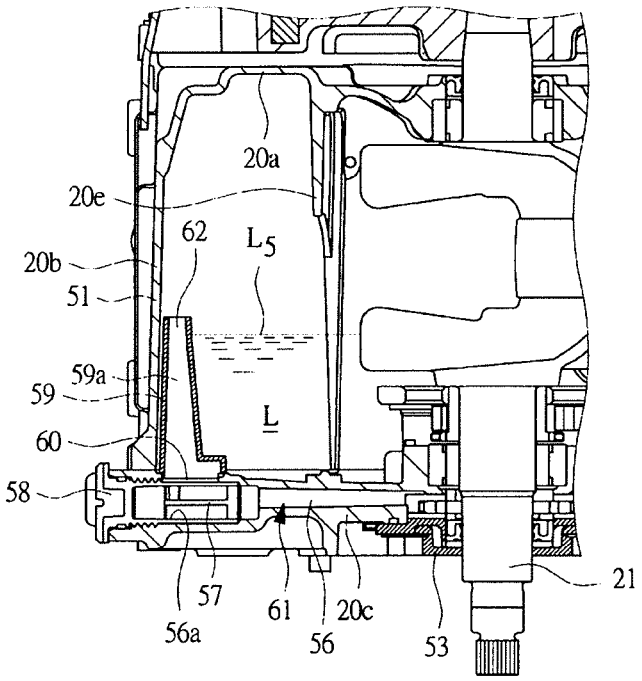
FIG. 5A is a cross-sectional view showing a liquid level within an oil pan, which is obtained when the rammer rolls over to the extent that a front surface side of the engine main body is tilted completely downward.
FIG. 5B is a cross-sectional view showing a liquid level within the oil pan, which is obtained when the rammer rolls over to the extent that the front surface side of the engine main body is tilted completely upward.
Figure 5:
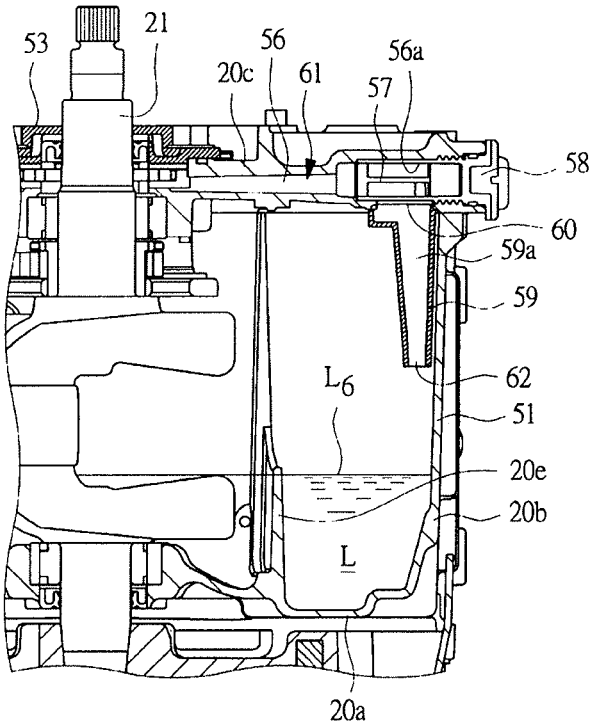
Figure 6:
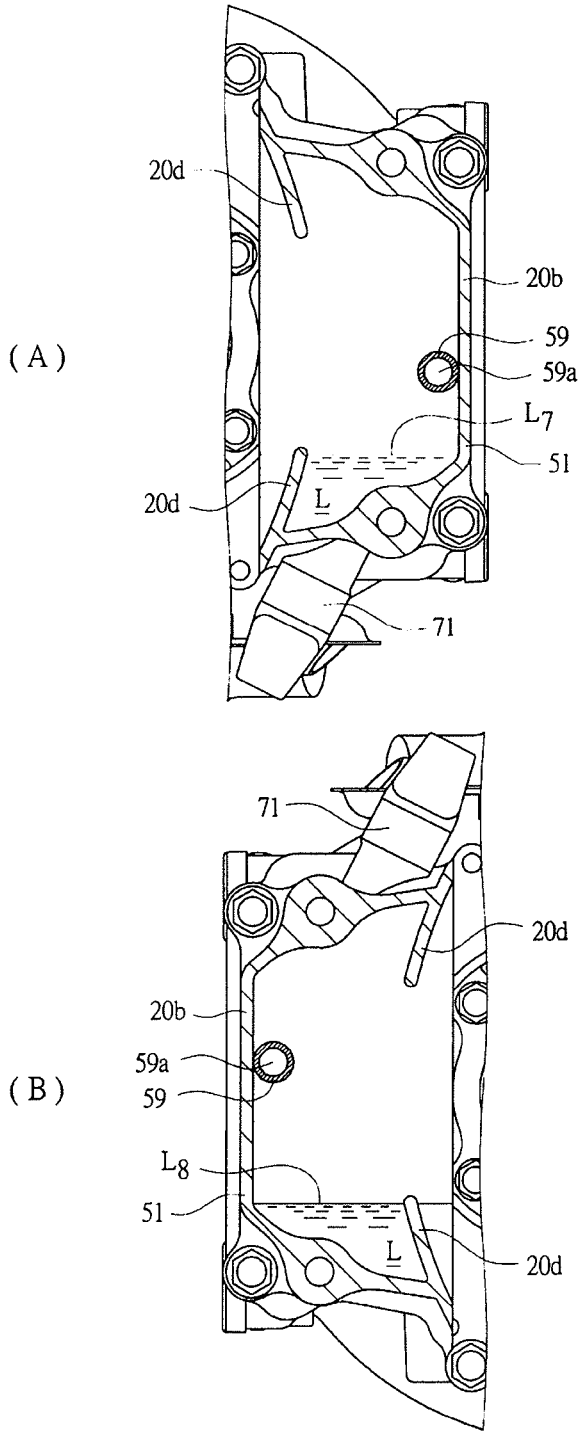
FIG. 6A is a cross-sectional view showing a liquid level within the oil pan, which is obtained when the rammer rolls over to the extent that one of side surfaces of the engine main body is tilted completely downward.
FIG. 6B a cross-sectional view showing a liquid level within the oil pan, which is obtained when the rammer rolls over to the extent that one of the side surfaces of the engine main body is tilted completely upward.

In the case of obtaining a configuration for detecting a rollover of the general-purpose engine 17 when the engine main body 17*a* rolls over to the positions shown in FIGS. 5 and 6, the rollover can be detected as long as the suction port 62 is positioned away from the inner surfaces of the end wall parts and side wall parts, without providing the suction port 62 in substantially the central part in both the front-rear direction and the lateral direction of the oil pan 51, as described above. The position of the suction port 62 is set based on the angle of the general-purpose engine rolling over in the front-rear direction or the lateral direction according to which the rollover is to be detected.

Although the suction port 62 is provided at the bottom part of the oil pan 51, the suction port 62 may be provided at a position higher than the illustrated positions, in the case of detecting a reduction in the remaining lubricating oil by means of the pressure sensor 66 when the oil level decreases to below a predetermined position as a result of a reduction in the amount of the lubricating oil L.

Figure 7:
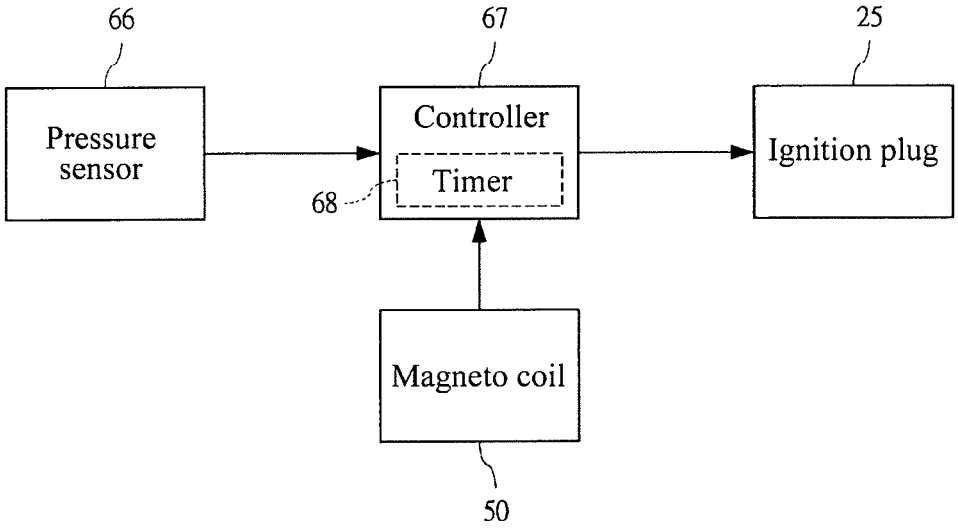
FIG. 7 is a block diagram showing an engine stop control circuit.

FIG. 7 is a block diagram showing an engine stop control circuit provided in the engine main body 17*a*. As shown in FIG. 7, the detection signals are transmitted from the pressure sensor 66 to a controller 67 serving as the engine stop control means. When the detection signals are output from the pressure sensor 66, the controller 67 applies an ignition voltage to the ignition plug 25 in order to drive the engine. The controller 67 has a timer 68, and stops applying the ignition voltage to the ignition plug 25 when the pressure sensor 66 does not output the detection signals even after the predetermined stop determination time has elapsed since the engine has started. The stop determination time is set to, for example, approximately three to five seconds. By stopping the engine based on the detection signals that are output from the pressure sensor 66 after a lapse of the stop determination time or more, erroneous operations involved in stopping the engine after starting the engine can be prevented. In other words, even when the engine is started when the engine 17 is not rolled over, the pressure of the lubricating oil L discharged to the lubricating oil discharge part 65 by the oil pump 52 does not reach a predetermined lubrication pressure until a predetermined time elapses since the start of the engine. Thus, by determining whether or not to stop the engine based on the detection signals that are output from the pressure sensor 66 after a lapse of the stop determination time or more, not only is it possible to reliably start the engine when it is not rolled over, but also the engine can be reliably stopped when it is rolled over.

When the rammer 10 rolls over after the engine is driven while the rammer 10 is not rolled over, the engine is stopped after the stop determination time elapses since the rollover. In this case, the engine may be immediately stopped even before the stop determination time elapses.

As described above, based on whether the pressure of the lubricating oil discharged from the oil pump 52 is at the lubrication pressure or not, a rollover of the general-purpose engine or the driving unit such as the rammer 10 is detected when the general-purpose engine or the driving unit rolls over in any of the four directions, i.e., to the front, rear, left and right. Consequently, whether the driving unit rolls over or not can be detected reliably without using the rollover sensor.

When the operator uses the above-mentioned rammer 10 to compact a paved surface or ground surface, the operator pulls out the operating knob 48 to start the engine while keeping the rammer 10 upright, as shown in FIG. 1. By pulling out the operating knob 48, the operator manually rotates the recoil pulley 47 shown in FIG. 3, whereby the crankshaft 21 is rotated. When the crankshaft 21 is rotated, the electric power generated by the magneto coil 50 is applied from the controller 67 to the ignition plug 25, and consequently the engine is started. During the initial stage of starting the engine, the oil pump 52 is not yet rotated normally, and the pressure of the lubricating oil L supplied from the oil pump 52 to the lubricating oil discharge part 65 does not yet reach the predetermined lubrication pressure. Based on the signals that are output from the pressure sensor 66 after a lapse of the predetermined stop determination time, a determination part of the controller 67 serving as the engine stop control means determines whether or not the lubricating oil L, the pressure of which reaches the lubrication pressure, is supplied to the lubricating oil discharge part 65.

When it is determined that the lubricating oil L is discharged from the oil pump 52 to the lubricating oil discharge part 65, the rammer 10 is driven without having the engine stopped. However, when the engine is started while the rammer 10 is rolled over, this means that the engine is started when the lubricating oil L does not flow into the lubricating oil intake part 61. Therefore, the lubricating oil, the pressure of which is increased to the lubricating oil, is stopped from being discharged to the discharge port 55 after a lapse of the stop determination time. As a result, the drive of the engine is stopped. On the other hand, when the rammer 10 rolls over while the rammer 10 with the general-purpose engine 17 driven is used for compacting a paved surface or ground surface, the lubricating oil L is no longer supplied continuously into to the lubricating oil intake part 61. Thus, when the entire lubricating oil remaining in the lubricating oil intake part 61 is discharged to the lubricating oil discharge part 65, the engine is stopped. In this manner, the engine is prevented from being driven when the lubricating oil is not supplied to the sliding sections or the lubrication sections.

Because the suction port 62 is opened at the central part both in the direction along the crankshaft 21 and in the direction perpendicular to the crankshaft 21, the engine is stopped when the rammer 10 is tilted in any of the four directions, i.e., to the front, rear, left and right, or tilted largely to the extent that it almost rolls over. Similarly, the engine is stopped from being continuously driven after the engine is started while the rammer 10 rolls over in any of the directions.

When replacing the filter 57 or discharging the lubricating oil L of the oil pan 51, the sealing plug 58 is removed from the crankcase 20. Because the sealing plug 58 is removed from below the crankcase 20 when the rammer 10 is set upright, the lubricating oil L within the oil pan 51 is discharged to the outside through the lubricating oil suction pipe 59 and the intake-side communication hole 56. The lubricating oil suction pipe 59 is disposed preferably in the bottom part of the oil pan 51 in order to use the lubricating oil suction pipe 59 for discharging the lubricating oil. An oil feeding plug 71 for injecting the lubricating oil into the oil pan 51 is detachably installed in the crankcase 20. The lubricating oil L is injected into the oil pan 51 with the oil feeding plug 71 removed from the crankcase 20.

The present invention is not limited to the embodiments described above, and various changes can be made within the scope of the present invention. The driving unit mounted with the general-purpose engine is not limited to the rammer 10 illustrated in the drawings. The present invention can be applied to another driving unit such as a power generator.

What is claimed is:

1. A rollover detection device for a general-purpose engine for detecting a rollover of a driving unit that has a member to be driven by an engine, the rollover detection device comprising:

an engine main body that has a cylinder in which a piston is installed so as to be able to reciprocate, and a crankcase in which a crankshaft connected to the piston by a connecting rod is installed rotatably;

an oil pan provided in a bottom part of the crankcase and storing lubricating oil;

an oil pump that is driven to rotate by the crankshaft;

a lubricating oil intake part, a suction port of which is provided at a position away from an end wall surface and side wall surface of the oil pan, and which guides the lubricating oil to an intake port of the oil pump;

a lubricating oil discharge part that guides the lubricating oil to a nozzle that supplies the lubricating oil, which is discharged from a discharge port of the oil pump, to a lubrication section within the engine main body;

discharge detecting means for detecting whether or not the lubricating oil is discharged from the discharge port of the oil pump; and engine stop control means for stopping the engine when the lubricating oil is not discharged into the lubricating oil discharge part, and wherein the oil pump is installed in a wall part of the crankcase, and an intake-side communication hole is formed within the wall part of the crankcase at a location of the wall part that defines a portion of the oil pan, and the lubricating oil intake part comprises the intake-side communication hole.

2. The rollover detection device for a general-purpose engine according to claim 1, wherein the engine stop control means stops the engine when a state in which the lubricating oil is not discharged into the lubricating oil discharge part continues for a stop determination time or longer.

3. The rollover detection device for a general-purpose engine according to claim 1, wherein the suction port of the lubricating oil intake part is opened at a central part of the oil pan in both a direction along the crankshaft and a direction perpendicular to the crankshaft.

4. The rollover detection device for a general-purpose engine according to claim 2, wherein the suction port of the lubricating oil intake part is opened at a central part of the oil pan in both a direction along the crankshaft and a direction perpendicular to the crankshaft.

5. A rollover detection device for a general-purpose engine for detecting a rollover of a driving unit that has a member to be driven by an engine, the rollover detection device comprising:

an engine main body that has a cylinder in which a piston is installed so as to be able to reciprocate, and a crankcase in which a crankshaft connected to the piston by a connecting rod is installed rotatably;

an oil pan provided in a bottom part of the crankcase and storing lubricating oil;

an oil pump that is driven to rotate by the crankshaft;

a lubricating oil intake part, a suction port of which is provided at a position away from an end wall surface and side wall surface of the oil pan, and which guides the lubricating oil to an intake port of the oil pump;

a lubricating oil discharge part that guides the lubricating oil to a nozzle that supplies the lubricating oil, which is discharged from a discharge port of the oil pump, to a lubrication section within the engine main body;

discharge detecting means for detecting whether or not the lubricating oil is discharged from the discharge port of the oil pump; and engine stop control means for stopping the engine when the lubricating oil is not discharged into the lubricating oil discharge part, and wherein the oil pump is installed in an end wall part of the crankcase, the crankshaft being supported rotatably in the end wall part, an intake communication hole is formed within the end wall part at a location of the end wall part defining a portion of the oil pan, a lubricating oil suction pipe formed with the suction port is attached to an opening part of the intake-side communication hole that is opened to the oil pan, and the lubricating oil intake part is formed by the intake-side communication hole and the lubricating oil suction pipe.

6. The rollover detection device for a general-purpose engine according to claim 2, wherein the wall part of the crankcase, in which the oil pump is installed, is in an end wall part of the crankcase, and in which end wall part the crankshaft is supported rotatably, and the intake-side communication hole is formed within the end wall part, a lubricating oil suction pipe formed with the suction port is attached to an opening part of the intake-side communication hole that is opened to the oil pan, and the lubricating oil intake part is formed by the intake-side communication hole and the lubricating oil suction pipe.

7. The rollover detection device for a general-purpose engine according to claim 3, wherein the wall part of the crankcase, in which the oil pump is installed, is in an end wall part of the crankcase, and in which end wall part the crankshaft is supported rotatably, and the intake-side communication hole is formed within the end wall part, a lubricating oil suction pipe formed with the suction port is attached to an opening part of the intake-side communication hole that is opened to the oil pan, and the lubricating oil intake part is formed by the intake-side communication hole and the lubricating oil suction pipe.

8. The rollover detection device for a general-purpose engine according to claim 4, wherein the wall part of the crankcase, in which the oil pump is installed, is in an end wall part of the crankcase, and in which end wall part the crankshaft is supported rotatably, and the intake-side communication hole is formed within the end wall part, a lubricating oil suction pipe formed with the suction port is attached to an opening part of the intake-side communication hole that is opened to the oil pan, and the lubricating oil intake part is formed by the intake-side communication hole and the lubricating oil suction pipe.

9. The rollover detection device for a general-purpose engine according to claim 5, wherein a discharge-side communication hole for allowing a communication between the discharge port and a nozzle is formed in the end wall part, and the lubricating oil discharge part is formed by the discharge-side communication hole.

10. The rollover detection device for a general-purpose engine according to claim 6, wherein a discharge-side communication hole for allowing a communication between the discharge port and a nozzle is formed in the end wall part, and the lubricating oil discharge part is formed by the discharge-side communication hole.

11. The rollover detection device for a general-purpose engine according to claim 7, wherein a discharge-side communication hole for allowing a communication between the discharge port and a nozzle is formed in the end wall part, and the lubricating oil discharge part is formed by the discharge-side communication hole.

12. The rollover detection device for a general-purpose engine according to claim 8, wherein a discharge-side communication hole for allowing a communication between the discharge port and a nozzle is formed in the end wall part, and the lubricating oil discharge part is formed by the discharge-side communication hole.

13. The rollover detection device for a general-purpose engine according to claim 1, wherein the discharge detecting means is a pressure sensor that detects a pressure of the lubricating oil discharged to the lubricating oil discharge part, and outputs a detection signal to the engine stop control means when a discharge pressure reaches a lubrication pressure.

14. The rollover detection device for a general-purpose engine according to claim 1, wherein the discharge detecting means is disposed within the lubricating oil discharge part.

15. The rollover detection device for a general-purpose engine according to claim 1, wherein within the lubricating oil intake part there is provided a filtering member for filtering the lubricating oil that is supplied from within the oil pan to the nozzle.

16. The rollover detection device for a general-purpose engine according to claim 1, wherein a filtering member is attached to a sealing plug that is detachably installed in the lubricating oil intake part, and the lubricating oil stored in the oil pan is discharged through the lubricating oil intake part by removing the sealing plug from the crankcase along with the filtering member.

17. The rollover detection device of claim 1 further comprising a lubricating oil suction conduit that extends off from and inwardly away from the wall part of the crankcase.

18. The rollover detection device of claim 17 wherein the suction conduit comprises a suction pipe having a central axis that extends from a suction port of the suction conduit toward an interior surface of the crankcase defining the wall part of the crankcase.

19. A rollover detection device for a general-purpose engine for detecting a rollover of a driving unit that has a member to be driven by an engine, the rollover detection device comprising:

an engine main body that has a cylinder in which a piston is installed so as to be able to reciprocate, and a crankcase in which a crankshaft connected to the piston by a connecting rod is installed rotatably;

an oil pan provided in a bottom part of the crankcase and storing lubricating oil;

an oil pump that is driven to rotate by the crankshaft;

a lubricating oil intake part, a suction port of which is provided at a position away from an end wall surface and side wall surface of the oil pan, and which guides the lubricating oil to an intake port of the oil pump;

a lubricating oil discharge part that guides the lubricating oil to a nozzle that supplies the lubricating oil, which is discharged from a discharge port of the oil pump, to a lubrication section within the engine main body;

discharge detecting means for detecting whether or not the lubricating oil is discharged from the discharge port of the oil pump; and engine stop control means for stopping the engine when the lubricating oil is not discharged into the lubricating oil discharge part, and wherein the suction port and crankcase are configured such that said discharge detecting means, when an oil level in the oil pan is at a preset fill level, detects a rollover of the driving unit for any and all directions of a complete tilt of the driving unit; and wherein the lubricating oil intake part comprises a suction conduit extending from the suction port to a base of the suction conduit located at a vertically extending interior wall surface of said crankcase, with said interior wall surface defining an intake-side communication hole formed within a portion of said vertically extending interior surface as to be in communication with the base of the suction conduit, and said portion of the interior wall surface defines a portion of the oil pan.

* * * * *